US012091869B2

(12) United States Patent
Wigfield

(10) Patent No.: US 12,091,869 B2
(45) Date of Patent: Sep. 17, 2024

(54) SYSTEM OF DRYWALL FINISHING IN BUILDING CONSTRUCTION

(71) Applicant: Level 6 Technologies, LLC, Lago Vista, TX (US)

(72) Inventor: Jeffrey S. Wigfield, Lago Vista, TX (US)

(73) Assignee: LEVEL 6 TECHNOLOGIES, LLC, Lago Vista, TX (US)

( * ) Notice: Subject to any disclaimer, the term of this patent is extended or adjusted under 35 U.S.C. 154(b) by 59 days.

(21) Appl. No.: 18/152,977

(22) Filed: Jan. 11, 2023

(65) Prior Publication Data

US 2023/0250650 A1 Aug. 10, 2023

Related U.S. Application Data

(63) Continuation-in-part of application No. 16/416,143, filed on May 17, 2019, now Pat. No. 11,608,648.

(60) Provisional application No. 62/672,667, filed on May 17, 2018.

(51) Int. Cl.

| | |
|---|---|
| ***E04F 21/165*** | (2006.01) |
| ***E04F 21/08*** | (2006.01) |
| ***E04F 21/16*** | (2006.01) |

(52) U.S. Cl.

CPC ..... *E04F 21/08* (2013.01); *E04F 21/163* (2013.01); *E04F 21/165* (2013.01); *E04F 21/1652* (2013.01); *E04F 21/1655* (2013.01); *E04F 21/1657* (2013.01)

(58) Field of Classification Search

CPC ..... E04F 21/08; E04F 21/163; E04F 21/165; E04F 21/1652; E04F 21/1655; E04F 21/1657

USPC ..... 401/48, 266

See application file for complete search history.

(56) References Cited

U.S. PATENT DOCUMENTS

| | | | | |
|---|---|---|---|---|
| 5,143,264 | A | 9/1992 | MacMillan | |
| 6,688,367 | B1 | 2/2004 | Ruposky et al. | |
| 6,874,965 | B1 | 4/2005 | Mondloch et al. | |
| 7,217,053 | B2 * | 5/2007 | Alexander | A47L 13/11 401/139 |
| 7,806,613 | B2 | 10/2010 | Mondloch et al. | |
| 9,889,464 | B1 | 2/2018 | Winne | |
| 2001/0003563 | A1 * | 6/2001 | Schauer | E04F 21/10 401/265 |
| 2003/0044220 | A1 * | 3/2003 | Vito | A47L 1/08 401/266 |

* cited by examiner

*Primary Examiner* — Jennifer C Chiang

(74) *Attorney, Agent, or Firm* — INNOVATION CAPITAL LAW GROUP, LLP; Vic Lin

(57) ABSTRACT

A system for finishing an interior or exterior drywall surface of a building structure can apply a predetermined formulation of dispensable compound material in liquefied form at a continuous flow with simultaneous surface finishing characteristics while reducing labor intensity and maximizing finish quality to a level 5 standard.

19 Claims, 16 Drawing Sheets

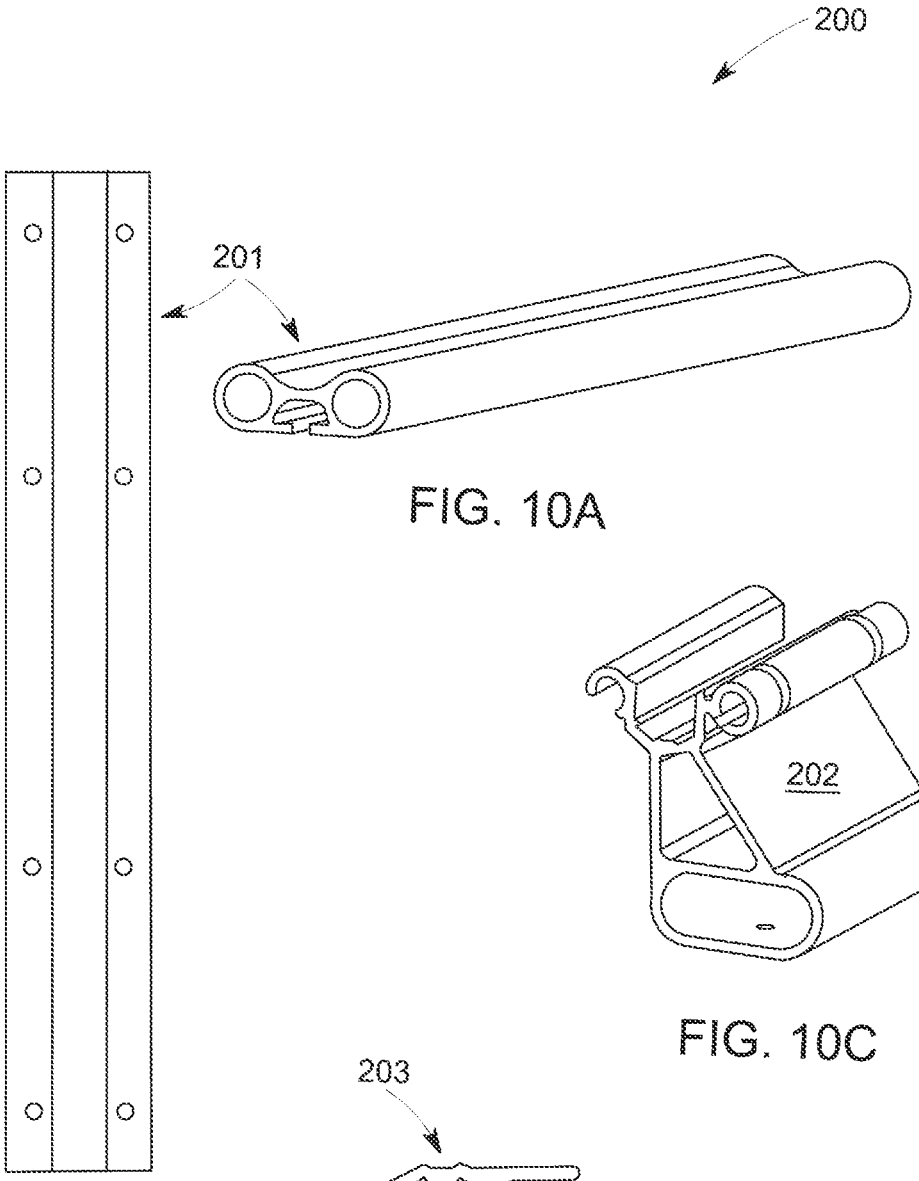
FIG. 10A
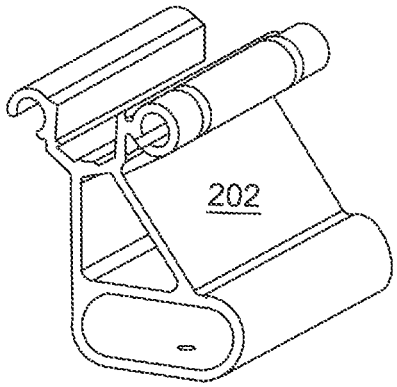
FIG. 10C
FIG. 10B
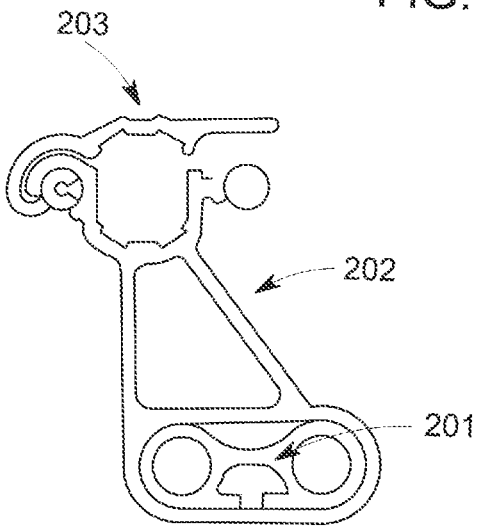
FIG. 10D

SYSTEM OF DRYWALL FINISHING IN BUILDING CONSTRUCTION

CROSS-REFERENCE TO RELATED APPLICATIONS

This application is a continuation-in-part of U.S. patent application Ser. No. 16/416,143, filed May 17, 2019, the contents of which are herein incorporated by reference.

BACKGROUND OF THE INVENTION

1. Field of the Invention

Embodiments of the invention relate generally to the field of building construction in connection with a high efficiency method and apparatus of delivering and distributing a source of liquefied compound and spraying said compound on a target drywall surface and uniformly finishing in a singular operation in a superior means. More specifically the present invention relates to a system of hand tools used in the simultaneous application and finishing treatment of drywall surfaces to a level 5 quality typically demanded for highest quality interior wall construction.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In the scope of interior wall construction in connection with building facilities, including but not limited to industrial, commercial or residential construction, various forms of materials also known as drywall, gypsum board, plasterboard, cement board, greenboard, blueboard, wood sheets or foam board are utilized in forming interior surfacing, and in some cases exterior building wall and/or ceiling systems, also generally referred to as interior wallboard construction. Again, various types of applicators or delivery systems, wipe down tools, knives and scrapers are used to create a flat finished wall of various levels of finishes from rough to fine finish.

One step method involves flat finishing boxes that apply compounds, mastics, coatings have been in use for years as articulated in U.S. Pat. No. 5,143,264. A laborer fills the head which can be attached to a handle and deliver compound onto an unfinished wall. Another method is to use a roller and knife combination as in U.S. Pat. No. 6,688,367. U.S. Pat. No. 6,874,965 is an improvement, where a tool is used to apply and smooth, but not to a level 5 finish and the compound to be applied is stored in the handle cylinder and must be frequently refilled. U.S. Pat. No. 7,806,613 is an improvement over prior art but is a delivery system only. Finally other approaches like that are U.S. Pat. No. 9,889,464, involve a water and sponge tool to eliminate sanding. Neither of these systems combine the multiple steps to create a level 5 finish in a single operation.

Such construction, while generally of flat surfaces in walls and ceilings, may also be a curved wall or ceiling by design where materials may be applied to various curvatures and non-conventional artistic treatments. Traditional plaster walls require a very labor-intensive fabrication process utilizing teams of skilled laborers for separate steps of application of surface compound, scraping excess compound and finishing the surface pursuant to the required final interior surface. In so doing, the operation depends upon speed, efficiency and cost-effective methods, especially today, in terms of competitive bidding of construction disciplines.

Individual pre-formed panels or equivalent materials are positioned and fastened side by side and top to bottom as continuous surfaces, which embody walls or ceilings, and are mounted and joined together into single building systems. Tape is generally applied over gaps, seams, or joints through the use of taping tools prior to applying and smoothing the surface coating.

Tape and mastic or equivalent are used in combination to seal, fill and conceal any gaps and secure the individual panels or equivalent material, with an objective result being to function and appear as a single seamless simple surface in individual building systems.

To complete this objective and create uniform surface quality and building system appearance and function, industrially referred to as "level 5" standard, it is necessary to apply a liquefied compound material, at large, to the overall building system surface over said tape and mastic, in order to provide for a high quality finish and uniformity of surface to minimize joint or fastener "photographing"/appearing through final decoration.

This all involves multiple steps of individual activities and intermediate wait periods and is very time consuming and tedious. The process described herein is extremely labor intensive, involves waste of surface compound and is not ergonomically compatible with physical exertion and strain of an operator. Many in the drywall labor force over several years develop physical impairments associated with musculoskeletal effects related to the drywall construction industry. Surface sanding creates hazardous airborne contaminants that are hazardous to labor.

SUMMARY OF THE INVENTION

Embodiments of the present invention provide a drywall finishing tool comprising a main body assembly; a frame having a proximal end extending from a distal end of the main body assembly; a floating head assembly disposed on a proximal end of the strut, the fixed frame, attached to a linear portion at an end of the strut, and a floating frame, pivotably attached to the fixed frame; a finishing blade attached at a distal end of the floating frame; and wheels attached at a distal end of the fixed frame.

Embodiments of the present invention further provide a drywall finishing tool comprising a main body assembly; a strut having a proximal end extending from a distal end of the main body assembly; a floating head assembly disposed on a proximal end of the strut, the fixed frame, attached to a linear portion at an end of the strut, and a floating frame, pivotably attached to the fixed frame; a finishing blade attached at a distal end of the floating frame; wheels attached at a distal end of the fixed frame; and one or more fixed frame magnets attached to the fixed frame and one or more floating frame magnets attached to the floating frame, wherein the fixed frame magnets repel the floating frame magnets to provide a dampening of movement between the fixed frame and the floating frame to minimize the pressure of the finishing blade on the surface being finished.

Embodiments of the present invention also provide a drywall finishing tool comprising a main body assembly; a strut having a proximal end extending from a distal end of the main body assembly; a floating head assembly disposed on a proximal end of the strut, a fixed frame, attached to a linear portion at an end of the strut, and a floating frame, pivotably attached to the fixed frame; a finishing blade attached at a distal end of the floating frame; wheels attached at a distal end of the fixed frame; and one or more fixed frame magnets attached to the fixed frame and one or more floating frame magnets attached to the floating frame, wherein the fixed frame magnets repel the floating frame magnets to provide a dampening of movement between the fixed frame and the floating frame, wherein the main body is a solid piece with two parallel tunnels running the length of the main body, wherein the parallel ends of the strut are inserted into the tunnels attaching the strut to the main body; the floating frame resiliently pivots relative to the fixed frame against one or more springs, wherein the one or more springs allow the finishing blade to float across a surface to remove excess material deposited by the drywall finishing tool while simultaneously smoothing/finishing the surface; and the fixed frame magnets utilize opposing force to repel the floating frame magnets in a direction against a force provided by resilient extension of the spring.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

FIG. 10A illustrates a perspective view of a double barrel main body design of the finishing tool of FIG. 7A;

FIG. 10B illustrates a top view of the double barrel main body of FIG. 10A;

FIG. 10C illustrates a perspective view of a sliding saddle of the finishing tool of FIG. 7A;

FIG. 10D illustrates an end view of the sliding saddle of FIG. 10C having the main body of FIG. 10A inserted therein;

Figure 1:
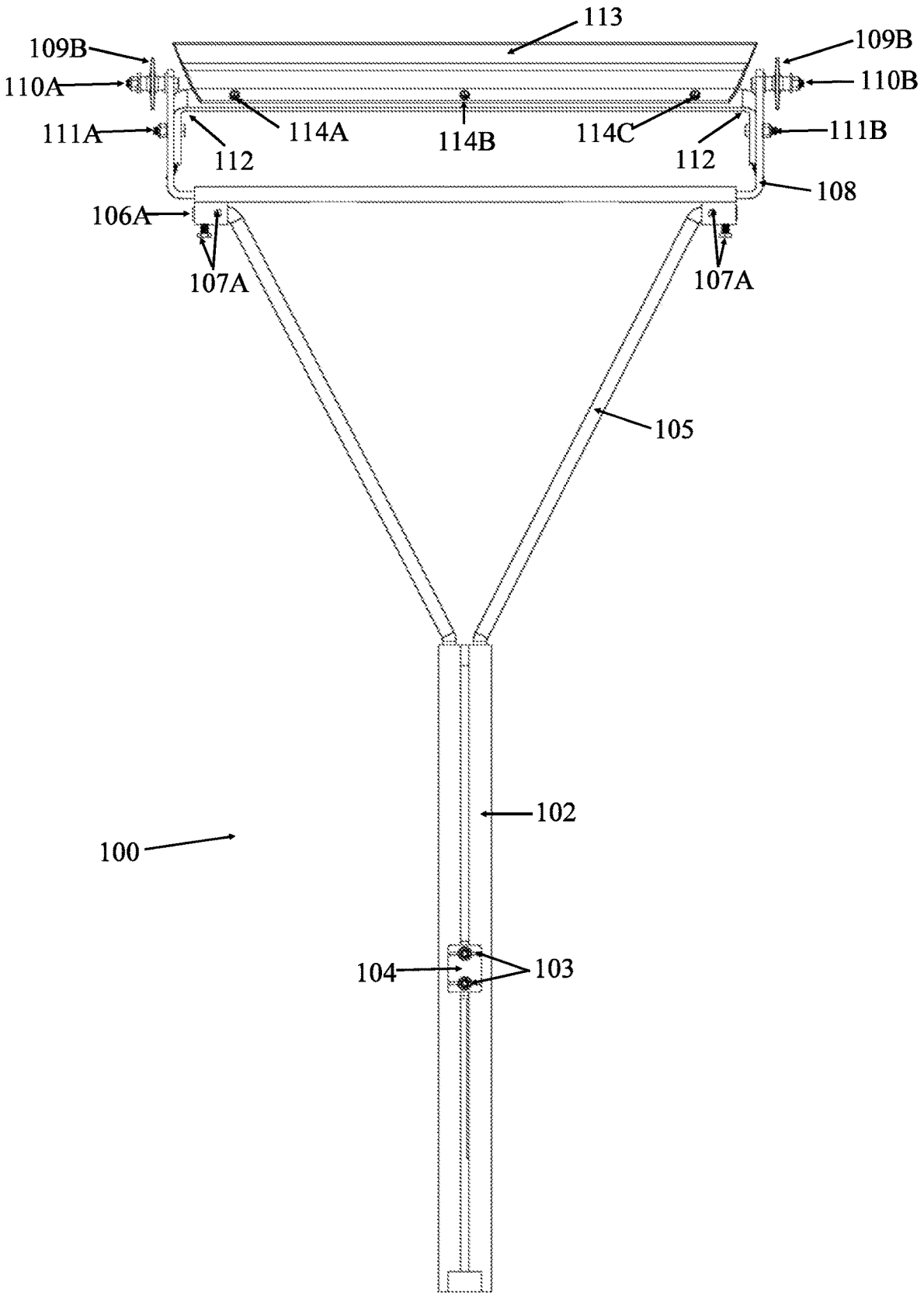
FIG. 1 illustrates a top view of a finishing tool according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a system for finishing an interior or exterior drywall surface of a building structure by applying a predetermined formulation of dispensable compound material in liquefied form at a continuous flow with simultaneous surface finishing characteristics while reducing labor intensity and maximizing finish quality to a level 5 standard.

The subject invention comprises a method and apparatus in a complete operation, that streamlines the currently employed and the scope of work of labor allocation and intensiveness, efficiency of liquefied compound application and surface finishing to desired properties and appearance.

A preferred embodiment of the apparatus is significantly reduced apparatus weight and ergonomics, for expediency in workmanship. In application by operation, the apparatus reduces compound waste as it utilizes consistently direct application at pre-determined distances from the output source to target surface thereby eliminating excess residual compound and waste. The tool is easy to manufacture thereby reducing expendable tool costs from project to project.

In combination with the compound delivery to the target surface the apparatus works in combination with a finishing tool simultaneous to the velocity and viscosity of the liquefied compound. There is no flat finishing box or storage cannon as utilized in existing continuous flow drywall tools The apparatus has the capability of performing and completing the same project scope of work at a factor of 3.5 (three and a half times) more efficiency than existing methods of construction and implementation.

Compound is driven from a source hopper tank through a hand held directed applicator consisting of an extension handle and distribution head that outputs formulation suitable for high speed drywall treatment in the form of variable characteristic droplets at predetermined velocity and viscosity in a fan shaped pattern from a spraying distribution head located on the tool handle with the finishing head, allowing one laborer to fulfill an operation normally comprising of a team of at least three laborers in individual steps.

In some embodiments, compound is driven from a source hopper/tank by an airless pump though a high-pressure hose, to the handheld finishing tool. The finishing tool feeds a high-pressure tube which supplies the spray head assembly that includes a spray tip housing and clean shot shut off valve. The spray head assembly outputs a formulation suitable for high-speed drywall treatment in the form of variable characteristic droplets at predetermined velocity and viscosity in a fan shaped pattern. The high-pressure tube is mounted on the underside of the finishing tool by a sliding saddle which is attached to the finishing tools handle/main body. The spray tip is positioned just below the finishing blade which is attached to the floating head assembly. This allows the finisher to simultaneously spray and float/finish the targeted surface in a single motion allowing one laborer to fulfill an operation normally comprising a team of at least three laborers in individual steps.

As an integral object of operation of the application apparatus includes: (a) the distance to the target surface is variable via the sliding saddle which allows the operator to move the spray head to a precise distance from the surface to obtain the desired surface quality; (b) the width and spread of the coverage to target surface is variable via the sliding saddle and interchangeable spray tips, as the width and coverage are controlled by the size of the spray tip and distance from the surface. This allows the operator to predetermine the placement and width of compound material distribution, density, and coverage; and (c) interchangeable finishing blade widths from 6" to 36" or more are attached to the floating head to create the desired surface quality and target coverage in (b). Prior to this tool, one had to manually apply the joint compound from a bucket to the wallboard, then go back with a separate tool and wipe the joint compound excess down to achieve a rough finish and then go through a further process of sanding and further smoothing. This resulted in a lot of wasted material as well as many wasted man hours.

This tool, by attaching it to an airless pumping system, applies the joint compound to the wallboard by spraying and smoothing the joint compound in one step. This will require only one man to perform what used to take at least three. The tool allows the user to control the fan of the joint compound with a conventional spray gun. The tool keeps the spray head the exact distance from the wallboard surface necessary to create the perfect joint compound fan and achieve a perfect finish. With the attached finishing blade, the tool will perfectly smooth the joint compound on the wallboard and joints, which will in turn achieve a perfect finish in one step with less material waste and less man hours.

The tool uses interchangeable struts to accommodate a variety of different size finishing blades which allows the tool to apply the 1st, 2nd and 3rd coats of joint compound that are required to finish wallboard. This tool will allow work to be performed from the floor on 10'-12' walls and ceilings without the need for scaffolding, stilts or ladders. One man can perform the work on both tops and bottoms of the wallboard.

A high-pressure hose, that can be up to 50 feet long or more, even up to 100 feet long, or more, is attached to the tool and connected to an airless pumping system fed from a large hopper filled with specially formulated joint compound which eliminates the need to go back and forth to a container of joint compound (mud) every two or three minutes to fill up a handheld pan or tool. Our tool applies the joint compound directly to the wallboard surface thereby not dropping it on the floor and wasting it. The user, and the user's work area will remain much cleaner than it would using the conventional methods.

The tool applies joint compound to a larger surface area than conventional joint compound application tools, making the joints much flatter and smoother than conventional methods. The typical 12" joint can become a 22" joint using less material while producing a smoother finish.

Once mastered, the tool will make applying joint compound much faster than it has ever been applied using conventional methods. The tool will make applying the sought after, flawless Level 5 finish much more achievable. It provides for consolidating a multiple of steps into one operation, making Level 5 applications of drywall material more efficient and utilizing less manpower and materials. Overall, one can achieve a smoother more perfect finish that will require much less sanding, waste and man hours than conventional application methods.

FIGS. 1 through 6 are described briefly below with respect to the elements illustrated therein. FIG. 1 shows a finishing tool 100, a handle 102, wingnuts 103 holding a sliding plate 104 in place on handle 102, the sliding plate on the handle 102 to secure the handle 102 to, for example, a Graco® extension pole or equivalent, a frame 105 that connects the handle 102 to the head of tool 100, a slot 106A to adjust angle of pivoting head, a slot 106B to adjust angle of pivoting head, a screw 107A that tighten the pivoting head into the slot, a screw 107B that tightens the pivoting head into the slot, a main frame 108 of head that controls wheel position, wheel 109A attached to main frame 108 of the head that will guide the spray fan, wheel 109B attached to the main frame 108 of the head that will guide the spray fan, bolt 110A, two washers and locknut that attach the wheel 109A to the main frame 108 of the head, bolt 110B, two washers and locknut that attach the wheel 109B to the main frame 108 of the head, bolt 111A, washer and locknut that attach the main frame 108 of the head to the squeegee frame 112, bolt 111B, washer and locknut that attach the main frame 108 of the head to the squeegee frame 112, a squeegee frame 112, a squeegee 113, a wing nut 114A that attaches the squeegee 113 to the squeegee frame 112, a wing nut 114B that attaches the squeegee 113 to the squeegee frame 112, and a wing nut 114C that attaches the squeegee 113 to the squeegee frame 112.

Figure 2:
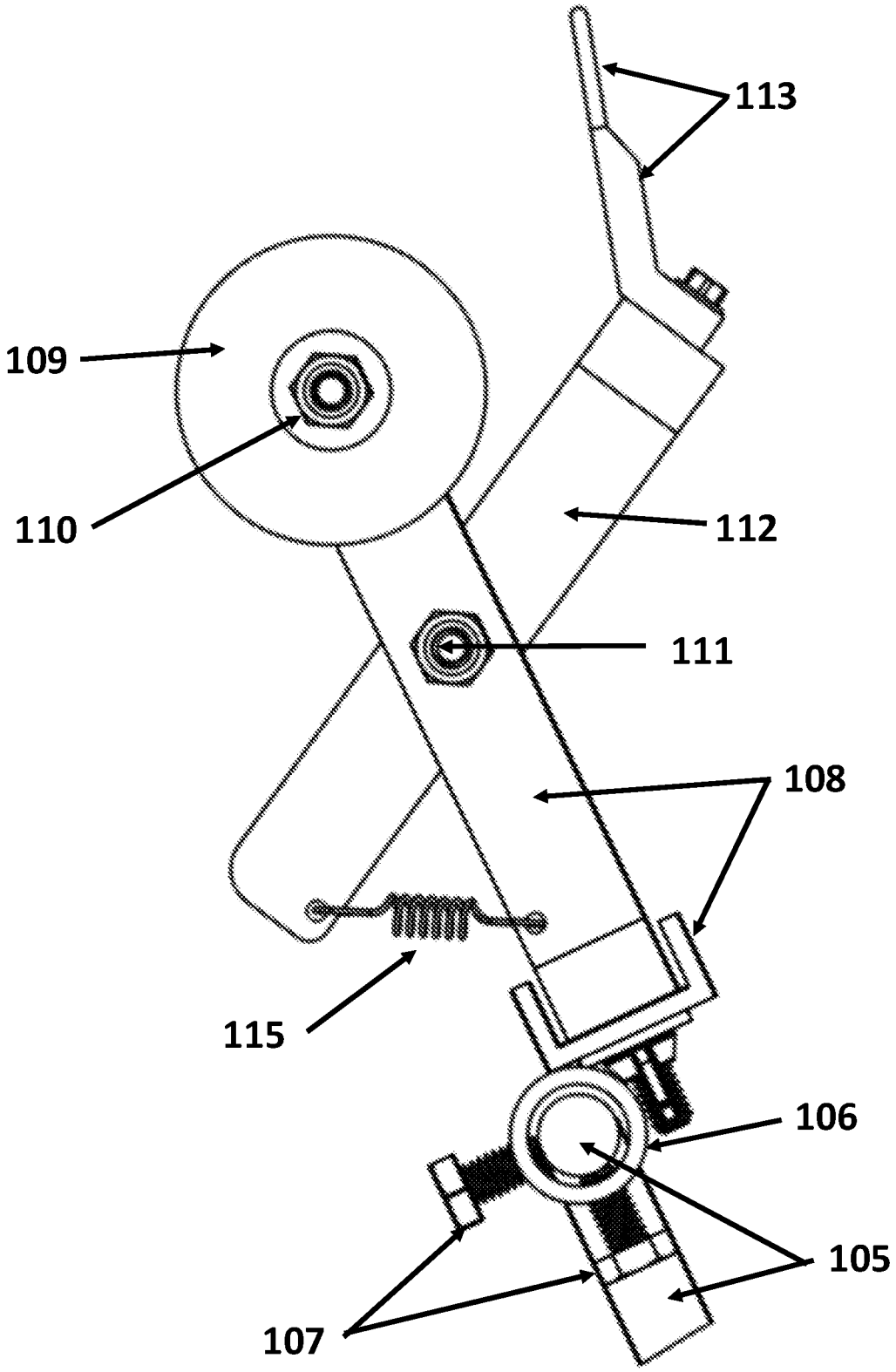
FIG. 2 illustrates a detailed side view of the main frame and squeegee frame of the finishing tool of FIG. 1.

FIG. 2 shows the finishing tool 100, the slot 106 to adjust the angle of the pivoting head, the screw 107 that tightens the pivoting head into slot, the main frame 108 of the head that controls the wheel position, the wheels 109 attached to the main frame 108 of the head that will guide the spray fan, the bolt 110, two washers and locknut that attach the wheel 109 to the main frame 108 of the head, the bolt 111, washer and locknut that attach the main frame 108 of the head to the squeegee frame 112, the squeegee 113 and a tension spring 115 that provides tension between the squeegee frame 112 and the main frame 108 of the head.

Figure 3:
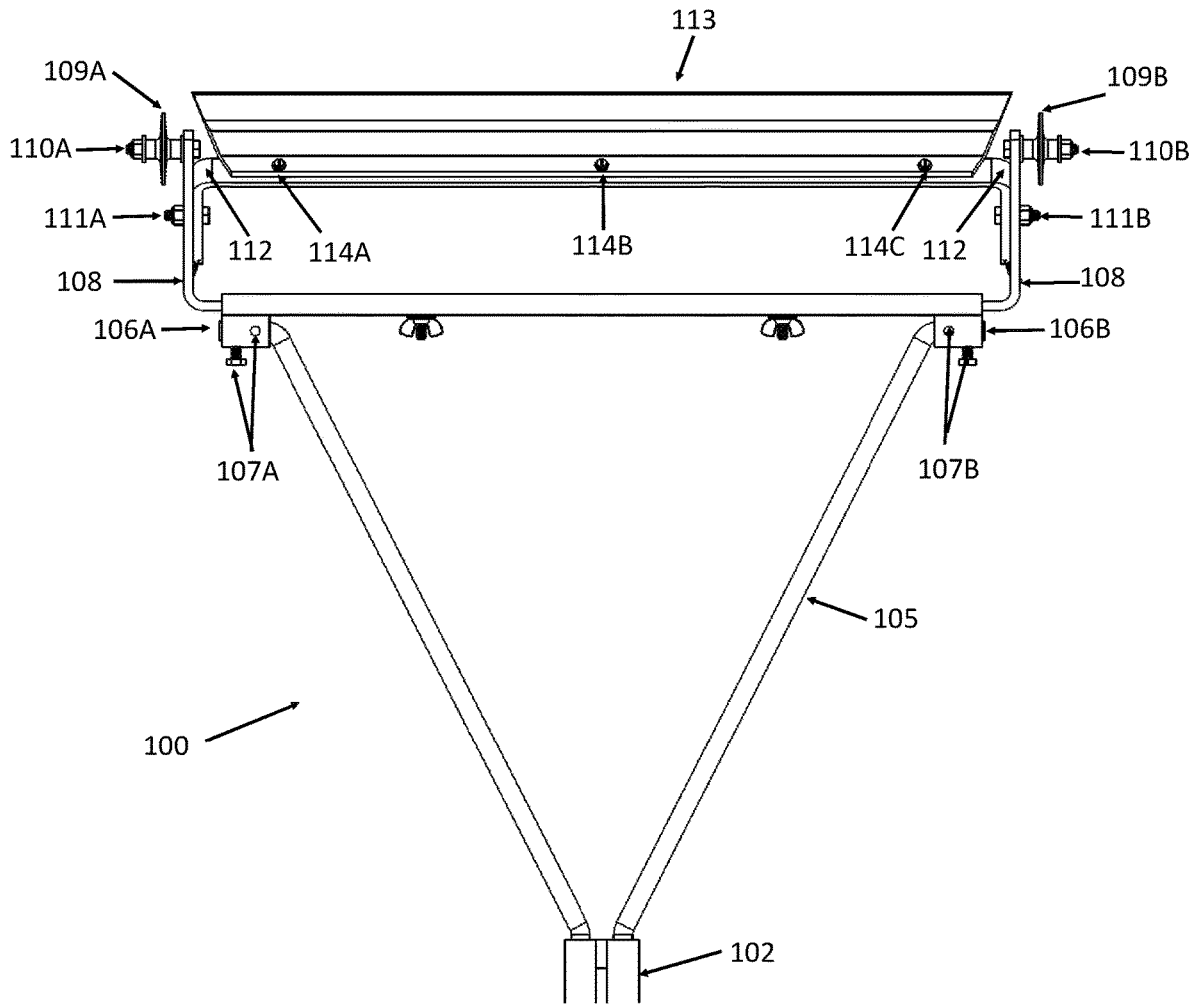
FIG. 3 illustrates a detailed top view of the finishing tool of FIG. 1.

FIG. 3 shows the finishing tool 100, the handle 102, the frame 105 that connects the handle 102 to the head of the tool 100, the slot 106A to adjust the angle of pivoting head, the slot 106B to adjust the angle of pivoting head, the screw 107A that tighten the pivoting head into the slot, the screw 107B that tightens the pivoting head into the slot, the main frame 108 of the head that controls the wheel position, the wheels 109A attached to the main frame 108 of the head that will guide the spray fan, the wheel 109B attached to the main frame 108 of the head that will guide the spray fan, the bolt 110A, two washers and locknut that attach the wheel 109A to the main frame 108 of the head, the bolt 110B, two washers and locknut that attach the wheel 109B to the main frame 108 of the head, the bolt 111A, washer and locknut that attach the main frame 108 of the head to the squeegee frame 112, the bolt 111B, washer and locknut that attach the main frame 108 of the head to the squeegee frame 112, the squeegee 113, the wing nut 114A that attaches the squeegee 113 to the squeegee frame 112, the wing nut 114B that attaches the squeegee 113 to the squeegee frame 112 and the wing nut 114C that attaches the squeegee 113 to the squeegee frame 112.

Figure 4:
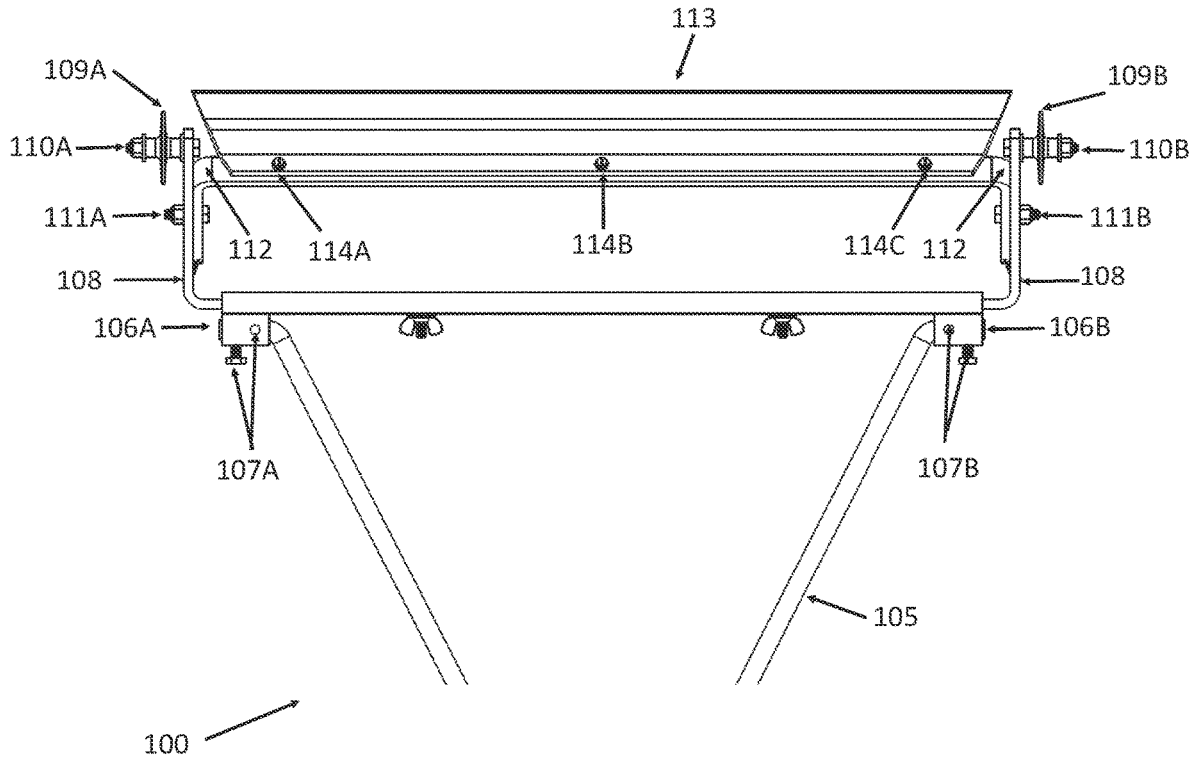
FIG. 4 illustrates a further detailed top view of the finishing tool of FIG. 1.

FIG. 4 shows the finishing tool 100, a frame 105 that connects the handle to the head of the tool, a slot 106A to adjust the angle of the pivoting head, a slot 106B to adjust the angle of the pivoting head, a screw 107A that tighten the pivoting head into the slot, a screw 107B that tightens the pivoting head into the slot, the main frame 108 of the head that controls the wheel position, wheels 109A attached to the main frame 108 of the head that will guide the spray fan, wheel 109B attached to the main frame 108 of the head that will guide the spray fan, the bolt 110A, two washers and locknut that attach the wheel 109A to the main frame 108 of the head, the bolt 110B, two washers and locknut that attach the wheel 109B to the main frame 108 of the head, the squeegee frame 112, the squeegee 113, the wing nut 114B that attaches the squeegee 113 to the squeegee frame 112 and the wing nut 114C that attaches the squeegee 113 to the squeegee frame 112.

Figure 5:
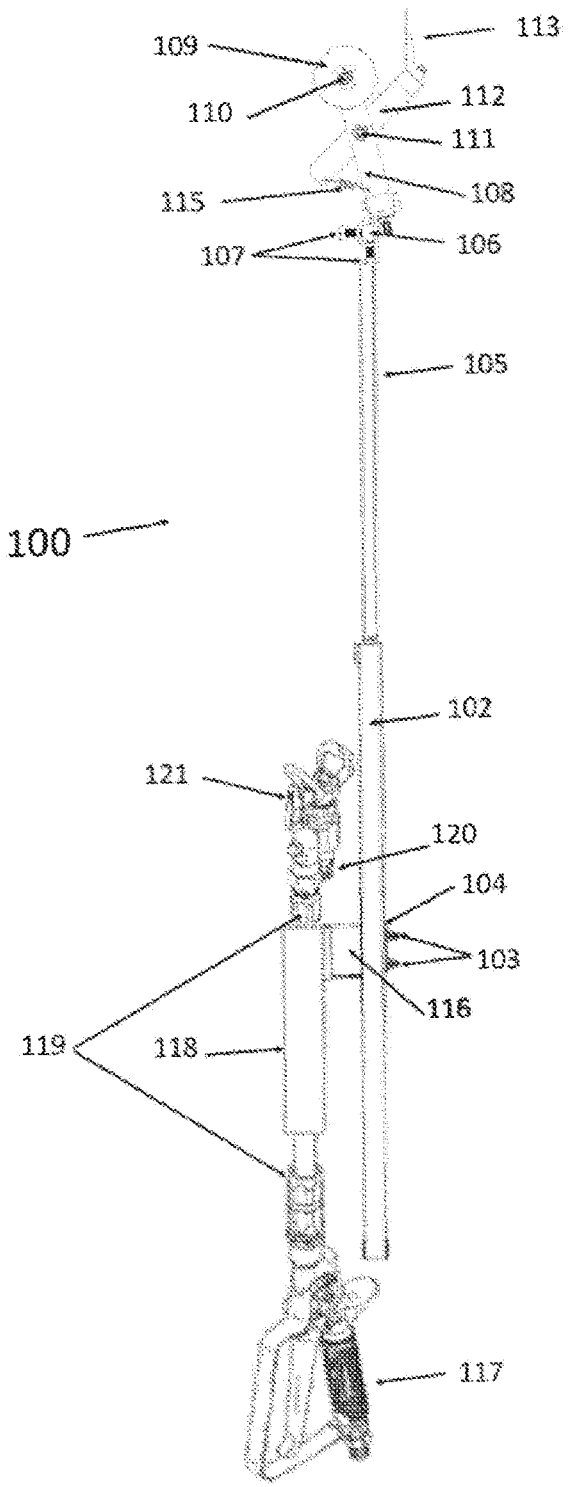
FIG. 5 illustrates a side view of the finishing tool of FIG. 1 with a spray gun attached thereto.

FIG. 5 shows the finishing tool 100, the handle 102, wingnuts 103 holding the sliding plate in place on the handle, a sliding plate 104 on the handle 102 to secure the handle 102 to, for example, a Graco® extension pole or equivalent, the frame 105 that connects the handle 102 to the head of the tool, the slot 106 to adjust the angle of pivoting head, the screws 107 that tighten the pivoting head into the slot, the main frame 108 of the head that controls the wheel position, wheels 109 attached to the main frame 108 of the head that will guide the spray fan, the bolt 110, two washers and locknut that attach the wheel 109 to the main frame 108 of the head, the bolt 111, washer and locknut that attach the main frame 108 of the head to, the squeegee frame 112, the squeegee 113, the tension spring 115 that provides tension between the squeegee frame 112 and the main frame 108 of the head, spacer 116 and housing for the sliding plate to attach the extension pole (Graco® used in this example), an airless spray gun 117 (Graco® used in this example), a quick handle attachment 118 (Graco® used in this example), an airless extension pole 119 (Graco® used in this example), a clean shot shutoff valve 120 (Graco® used in this example) and spray tip and housing 121 (Graco® used in this example).

Figure 6:
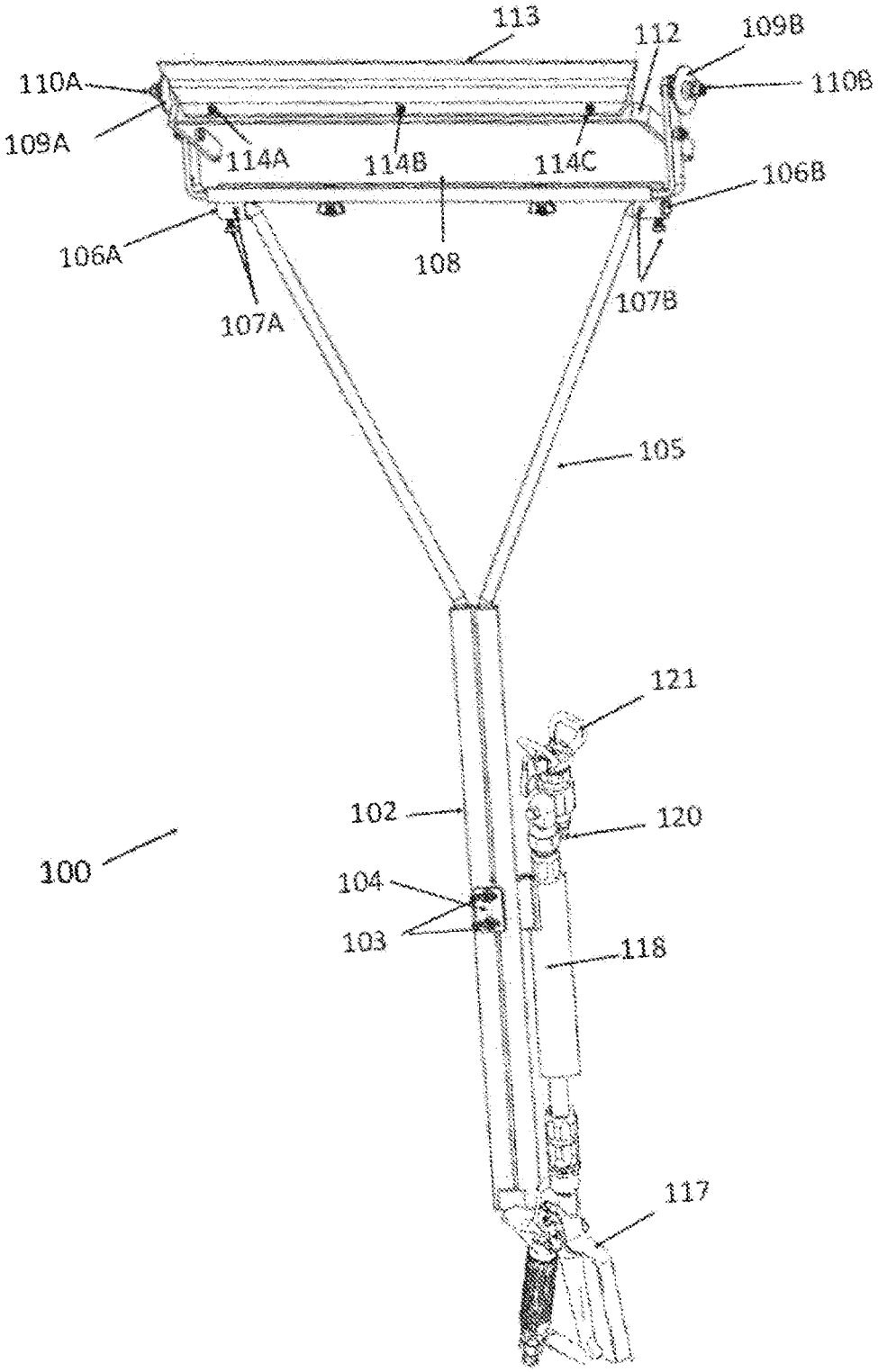
FIG. 6 illustrates a top perspective view of the finishing tool of FIG. 1 with a spray gun attached thereto.
Figure 7A:
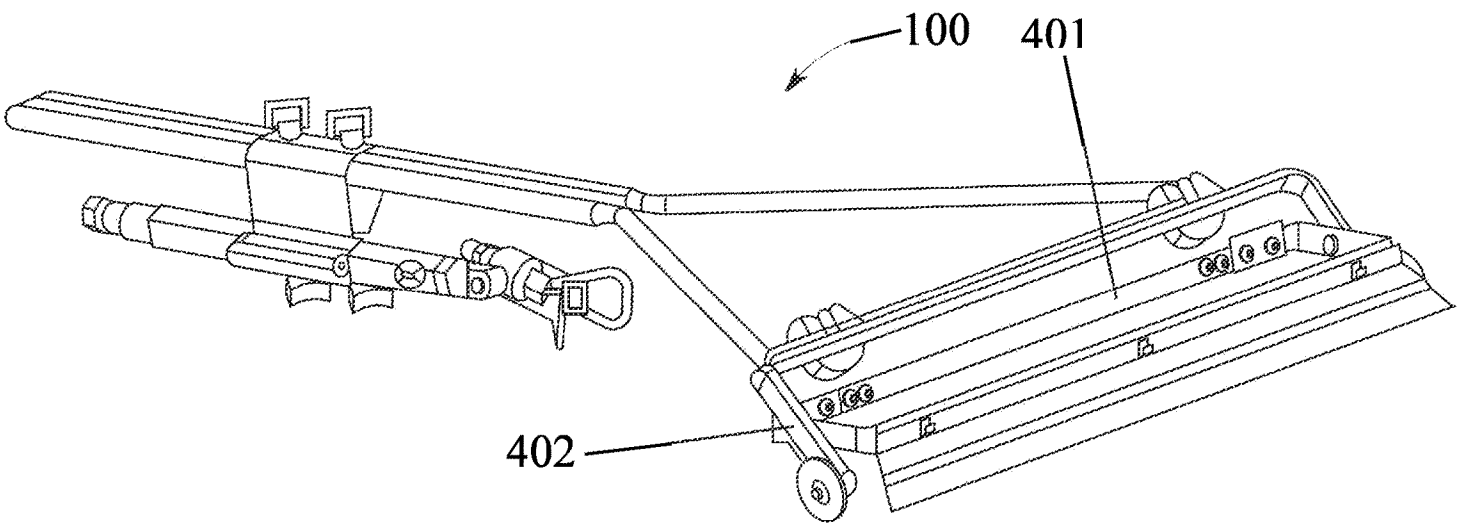
FIG. 7A illustrates a top perspective view of a finishing tool according to an exemplary embodiment of the present invention.
Figure 7B:
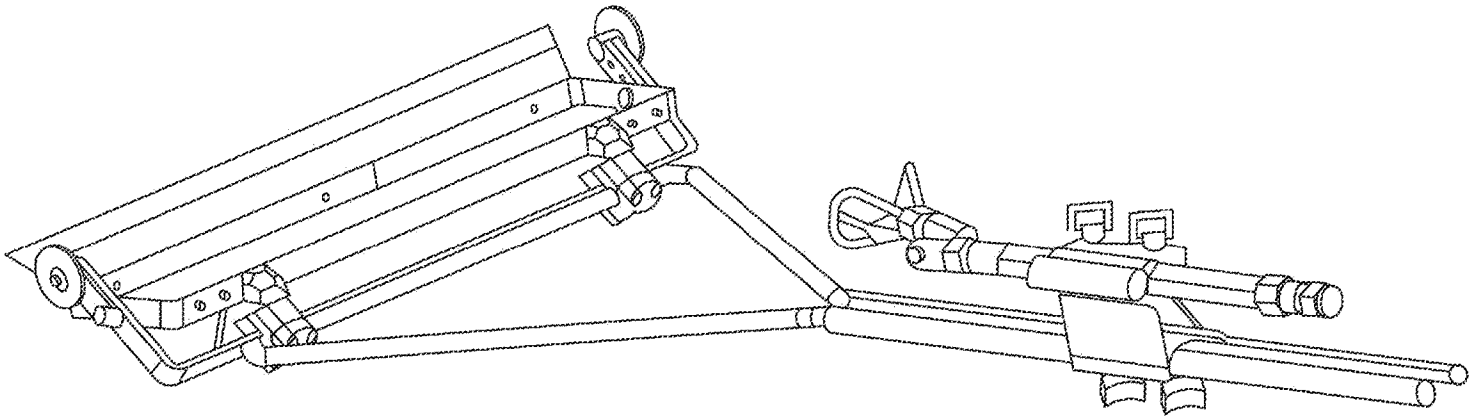
FIG. 7B illustrates a bottom perspective view of a finishing tool of FIG. 7A.

FIG. 6 shows the finishing tool 100, the handle 102, the wingnuts 103 holding the sliding plate 104 in place on the handle 102, the sliding plate on the handle 102 to secure the handle 102 to the Graco® extension pole, the frame 105 that connects the handle 102 to the head of the tool, the slot 106 to adjust the angle of the pivoting head, the screws 107 that tighten the pivoting head into the slot, the main frame 108 of the head that controls the wheel position, wheels 109 attached to the main frame 108 of the head that will guide the spray fan, the bolt 110, two washers and locknut that attach the wheel 109 to the main frame 108 of the head, the squeegee frame 112, the squeegee 113, the wing nut 114A that attaches the squeegee 113 to the squeegee frame 112, the wing nut 114B that attaches the squeegee 113 to the squeegee frame 112 and the wing nut 114C that attaches the squeegee 113 to the squeegee frame 112, the airless spray gun 117 (Graco® used in this example), the quick handle attachment 118 (Graco® used in this example), a clean shot shutoff valve 120 (Graco® used in this example) and spray tip and housing 121 (Graco® used in this example).

Figure 8:
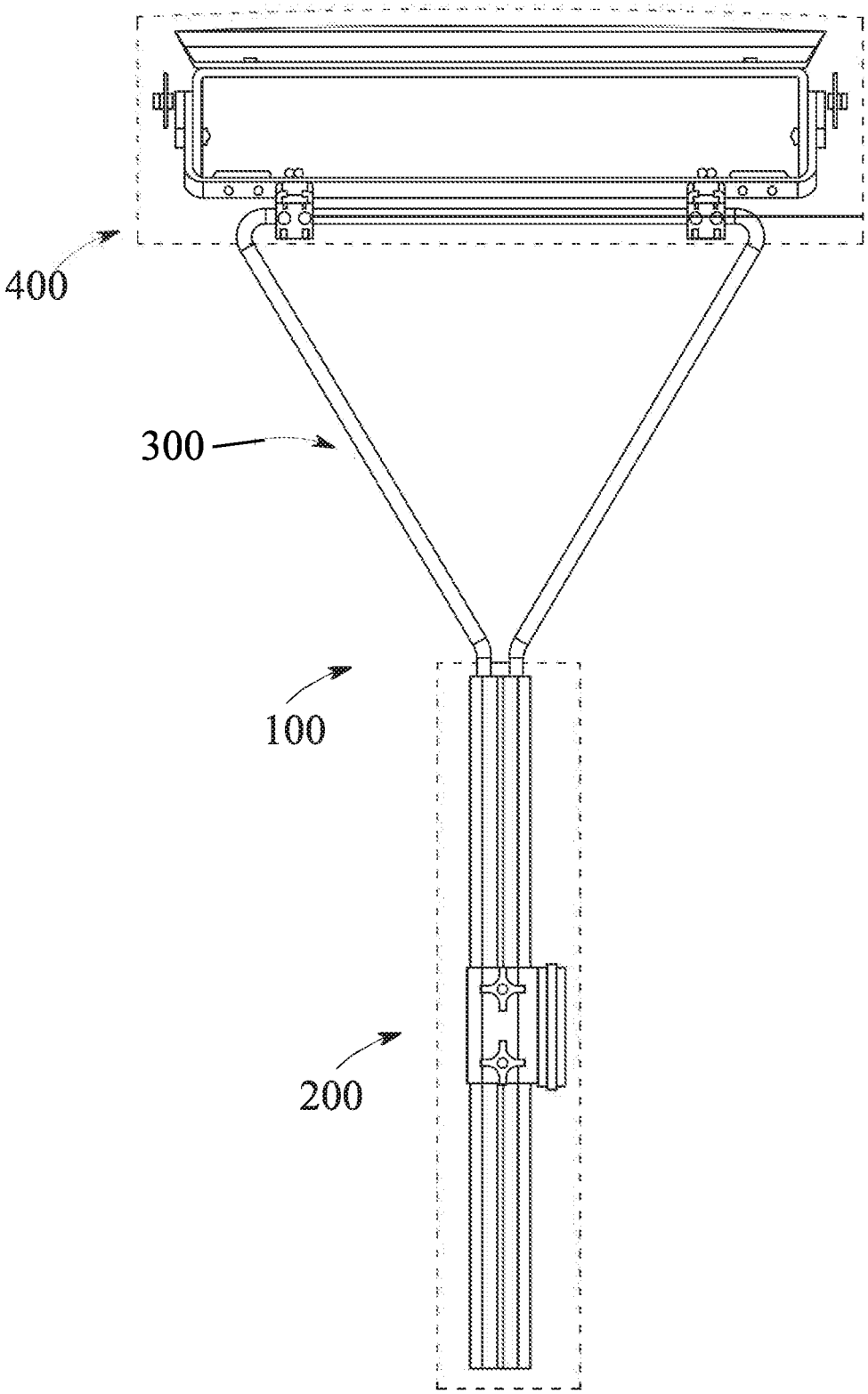
FIG. 8 illustrates a top view of the finishing tool of FIG. 7A.

Referring now to FIGS. 7A through 18, another embodiment of a finishing tool is illustrated. Like reference numerals represent like components as those discussed above with respect to FIGS. 1 through 6. The finishing tool 100 can include a floating head assembly 400 (shown generally within the upper dashed line box of FIGS. 8 and 9), a /strut 300 that connects main body 201 to the floating head assembly 400, and a main body assembly 200 (shown generally within the lower dashed lined box of FIGS. 8 and 9).

Figure 9A:
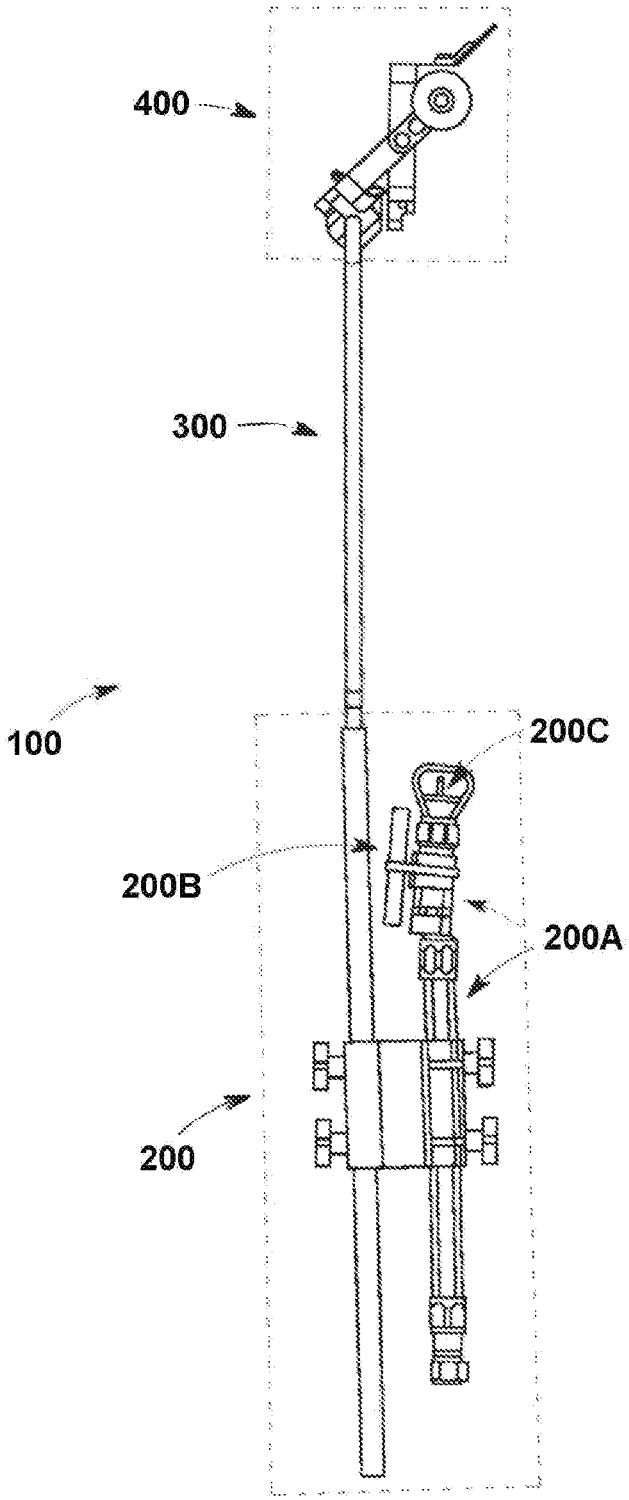
FIG. 9A illustrates a side view of the finishing tool of FIG. 7A.
Figure 9B:
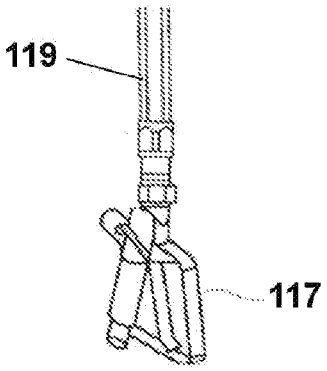
FIG. 9B illustrates a detailed sprayer handle view of the finishing tool of FIG. 7A with airless spray gun attached (Graco® used in example)

As shown in FIG. 9A, the main body assembly 200 can include a laser 200B attached near the spray head, where the laser 200B can be used to calibrate and align the spray tip 200C (Graco® used in this example) of the airless high pressure extension pole and spray head 200A (Graco® used in this example) which allows the spray tip 200C (Graco® used in this example) to spray a precise amount of specially formulated compound from the spray head onto a surface (such as the wall, ceiling, or the like) with laser/pinpoint accuracy. The main body assembly 200 can further include an airless high-pressure extension pole and spray head 200A (Graco® used in this example). As shown in FIG. 9B, an airless high-pressure extension pole 119 (Graco® used in this example) can attach to an airless spray gun trigger handle 117 (Graco® used in this example) which can be used to control flow of compound out of the spray head.

Figure 11:
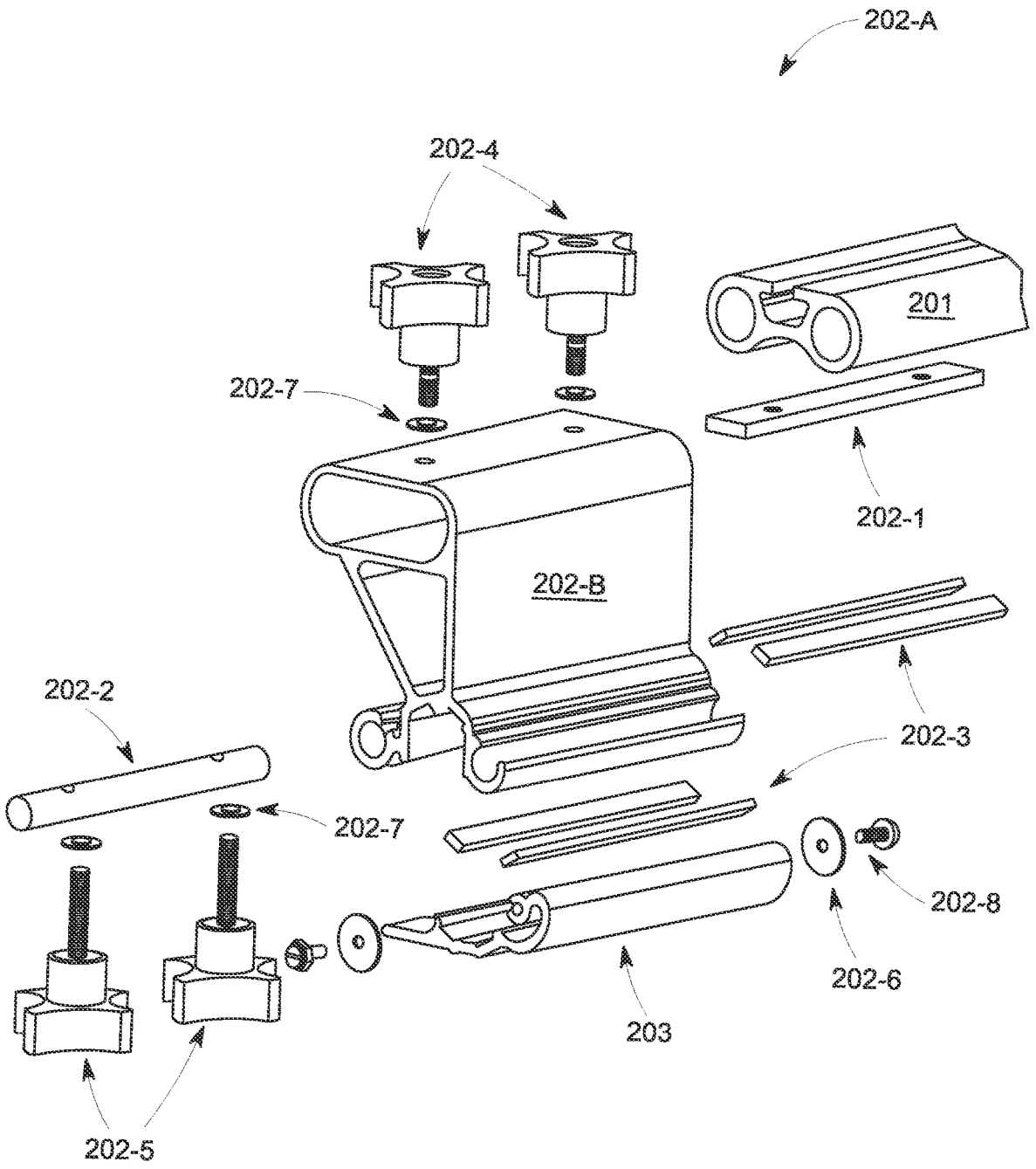
FIG. 11 illustrates an exploded perspective view of the sliding saddle of FIG. 10C and the main body of FIG. 10A.

Referring to FIGS. 10A through 11, details of the main body assembly 200 are shown. The main body 201 may be a double barrel main body or similar structure that can be received in a sliding saddle 202, as shown in FIG. 10D. The sliding saddle 202 can include a quick release sliding saddle clamp 203. The quick release sliding saddle clamp 203 allows for the quick change of the main body 201 and allows the operator to adjust the distance of the spray tip 200C (FIG. 9A) to the surface being sprayed which adjusts the width of the spray fan.

As best shown in FIG. 11, the sliding saddle assembly 202-A is shown, where the main body 201 can fit into the opening of the sliding saddle 202-B. Knobs 202-4 go through washers 202-7 and then can fit through the sliding saddle 202-B to secure the main body 201 when the main body 201 is inserted in the opening. A nut plate 202-1 may be used to secure the knobs 202-4 inside the opening. In some embodiments, a channel between the two barrels of the main body 201 may receive the nut plate 202-1 and the knobs 202-4 go through washers 202-7 so they may screw into the nut plate 202-1 to secure the main body 201 in a desired position. Of course, other means may be used to secure the main body 201 with the sliding saddle 202-B as may be known in the art.

On the side opposite that of the opening into which the main body 201 fits, the sliding saddle 202-B includes the quick release sliding saddle clamp 203 for removing or attaching the airless high-pressure extension pole 119 (FIG. 9B) which is attached to an airless spray gun with trigger handle 117 (FIG. 9B), as discussed above. Clamp pads 202-3 may be disposed on both the sliding saddle 202-B and on the quick release sliding saddle clamp 203 to help prevent movement of the airless high-pressure extension pole 119 (FIG. 9B) and airless spray gun with trigger handle 117 (FIG. 9B) when installed. Knobs 202-5 may be used with washers 202-7 and a clamp pivot shaft 202-2 for securing the quick release sliding saddle clamp 203 in the closed position. Screws 202-8 and washers 202-6 may be used on one side of the quick release sliding saddle clamp 203 to secure the quick release sliding saddle clamp 203 onto the sliding saddle 202-B in a pivoting arrangement. In use, the user can loosen the knobs 202-5 to rotate the clamp pivot shaft 202-2 to remove the engagement between the knobs 202-5 and the edge of the quick release sliding saddle clamp 203, thus allowing the clamp 203 to pivot (at an axis near the screws 202-8) to create an opening for placement, adjustment, or removal of the airless high-pressure extension 119 and airless spray gun 117 (FIG. 9B).

Figure 12A:
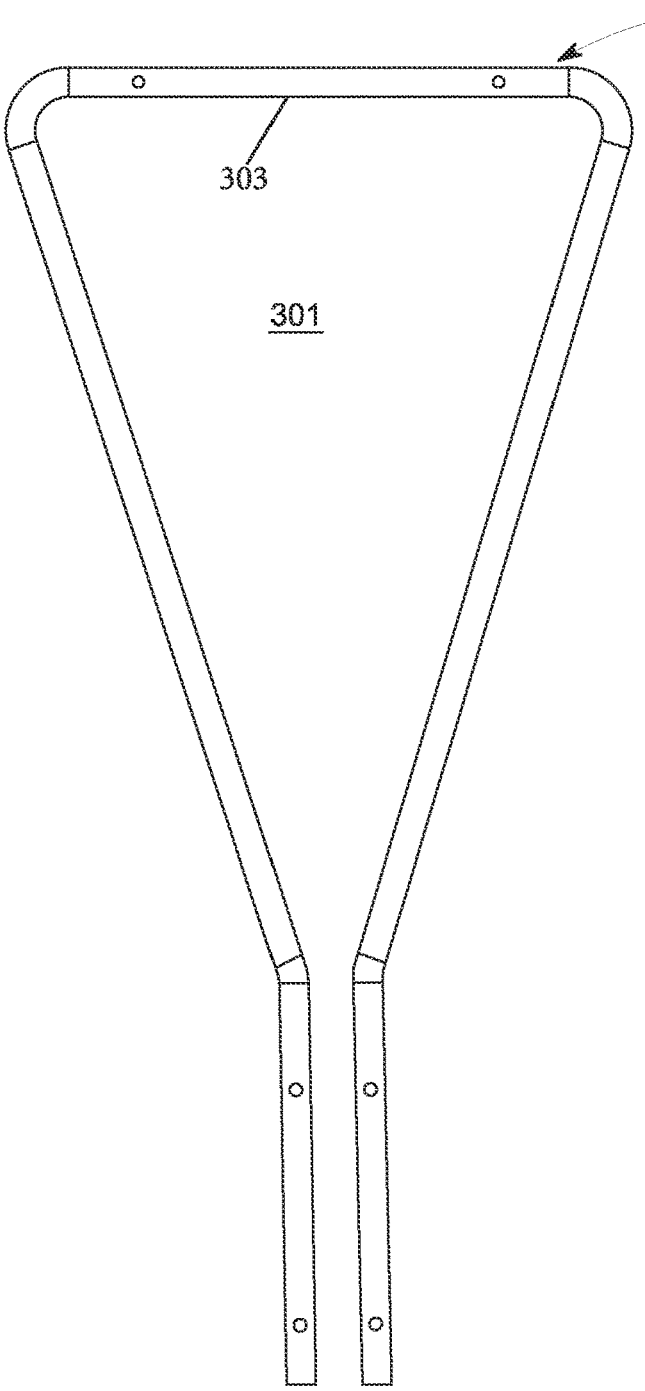
FIG. 12A is a top view of a wide strut of the finishing tool of FIG. 7A.
Figure 12B:
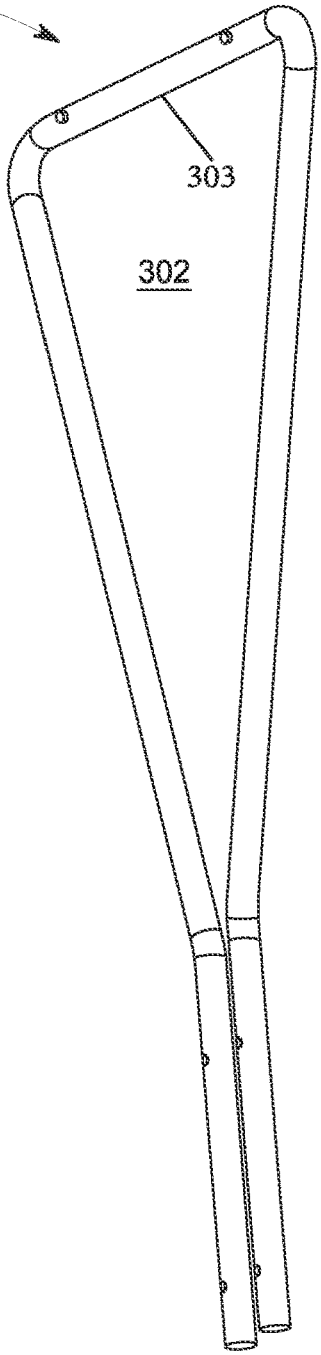
FIG. 12B is a perspective view of a narrow strut of FIG. 12A.
Figure 12C:
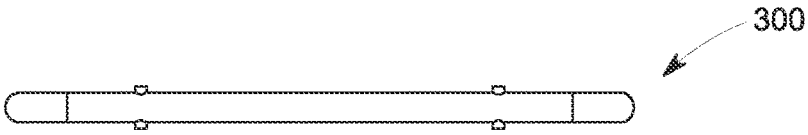
FIG. 12C is an end view of the strut of FIG. 12A.

FIGS. 12A through 12C illustrates details of the strut 300, where the strut 300 is in the shape of an open/acute isosceles triangle with the acute/open ends spread apart to form short parallel legs which are inserted into the open ends of the main body 201 (FIG. 10D) to attach the strut 300 to the main body 201. The strut 300 may consist of various shapes and sizes, including a wide strut 301, as shown in FIG. 12A, and a narrow strut 302, as shown in FIG. 12B. In other words, the strut 300 may include two parallel legs at a proximate end that attach to the end of the double barrel main body 201. The two legs can angle away from each other and curve to meet along a distal linear edge (upon which the floating head assembly 400 is mounted). Depending on the size of the squeegee, different struts having different lengths of the linear head assembly attachment portion 303, may be provided. Of course, a single size of the strut 300 may be used and the floating head assembly 400 may extend beyond the ends of the linear head assembly attachment portion 303.

Figure 13:
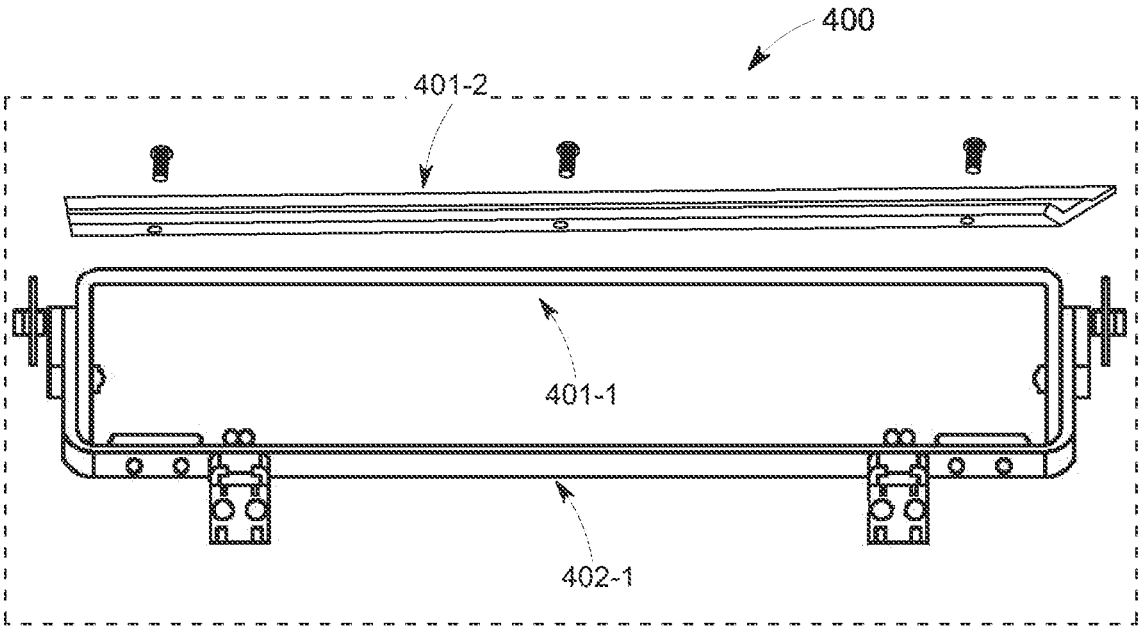
FIG. 13 illustrates an exploded perspective view of a floating head assembly of the finishing tool of FIG. 7A.
Figure 14:
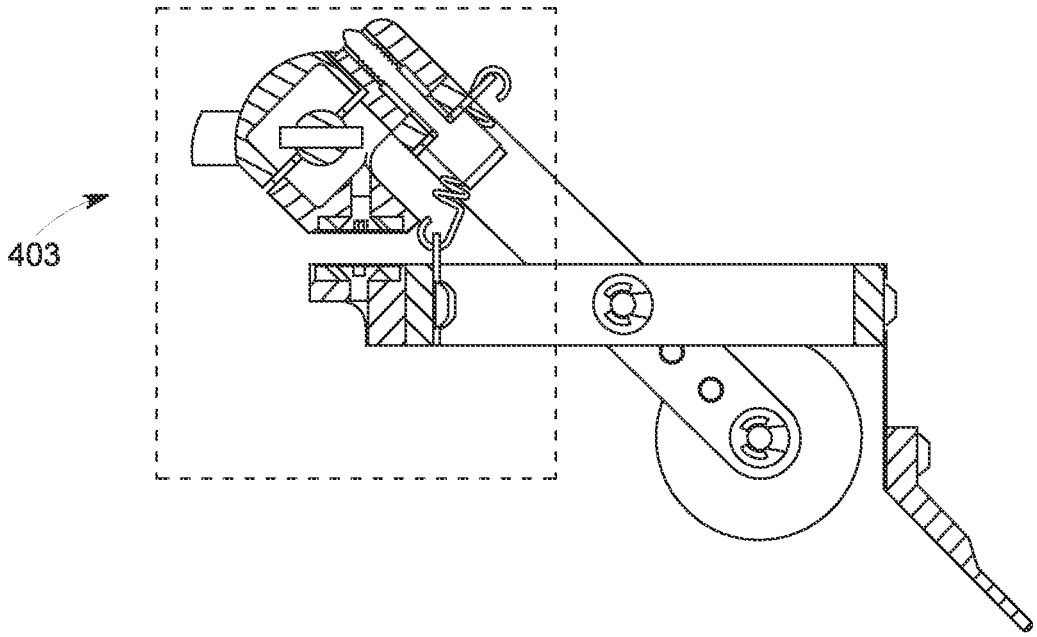
FIG. 14 illustrates a detailed side view of an opposing force damper assembly of the finishing tool of FIG. 7A.
Figure 15:
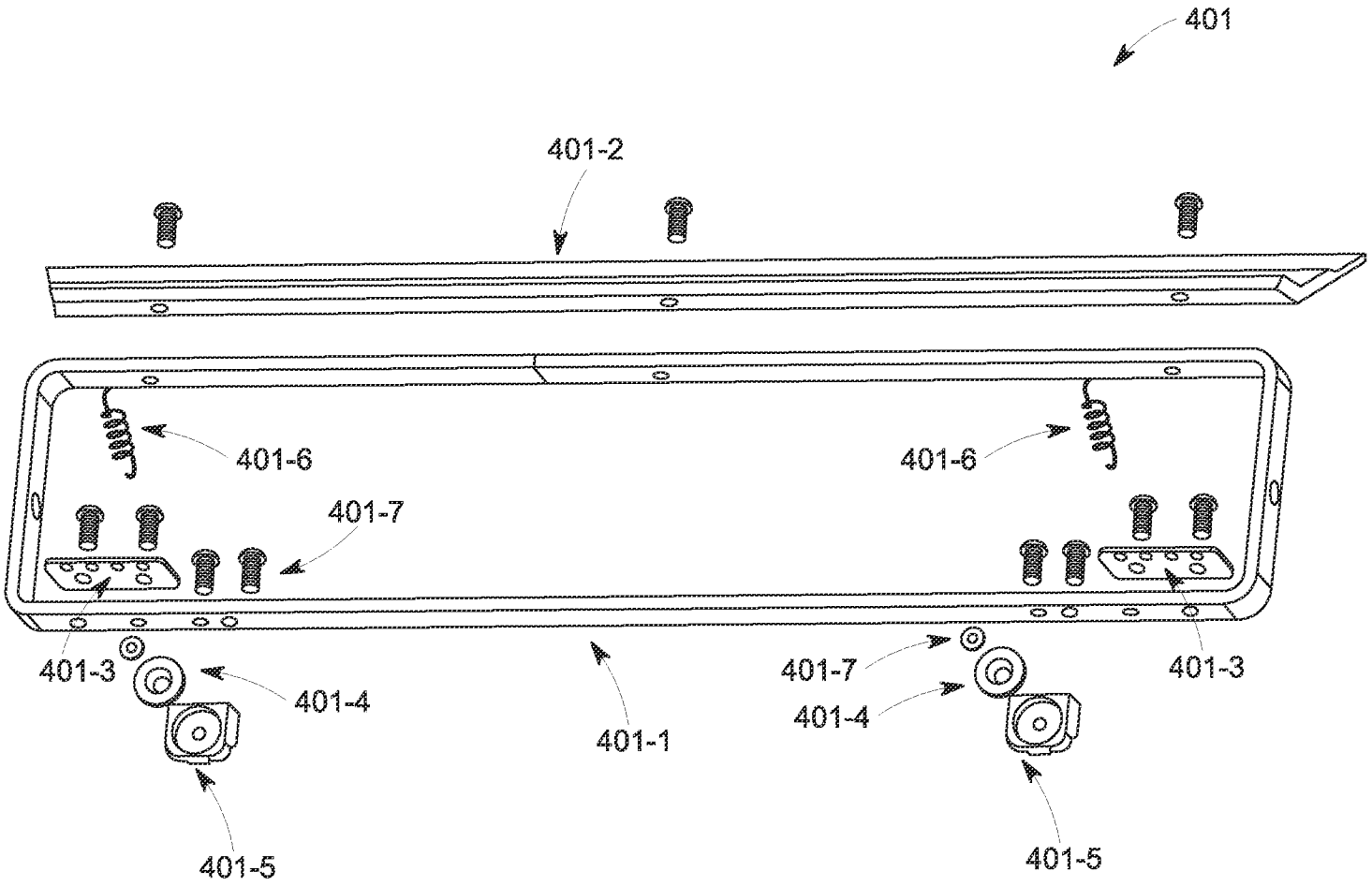
FIG. 15 illustrates a detailed exploded perspective view of the floating frame assembly of the finishing tool of FIG. 7A.
Figure 16:
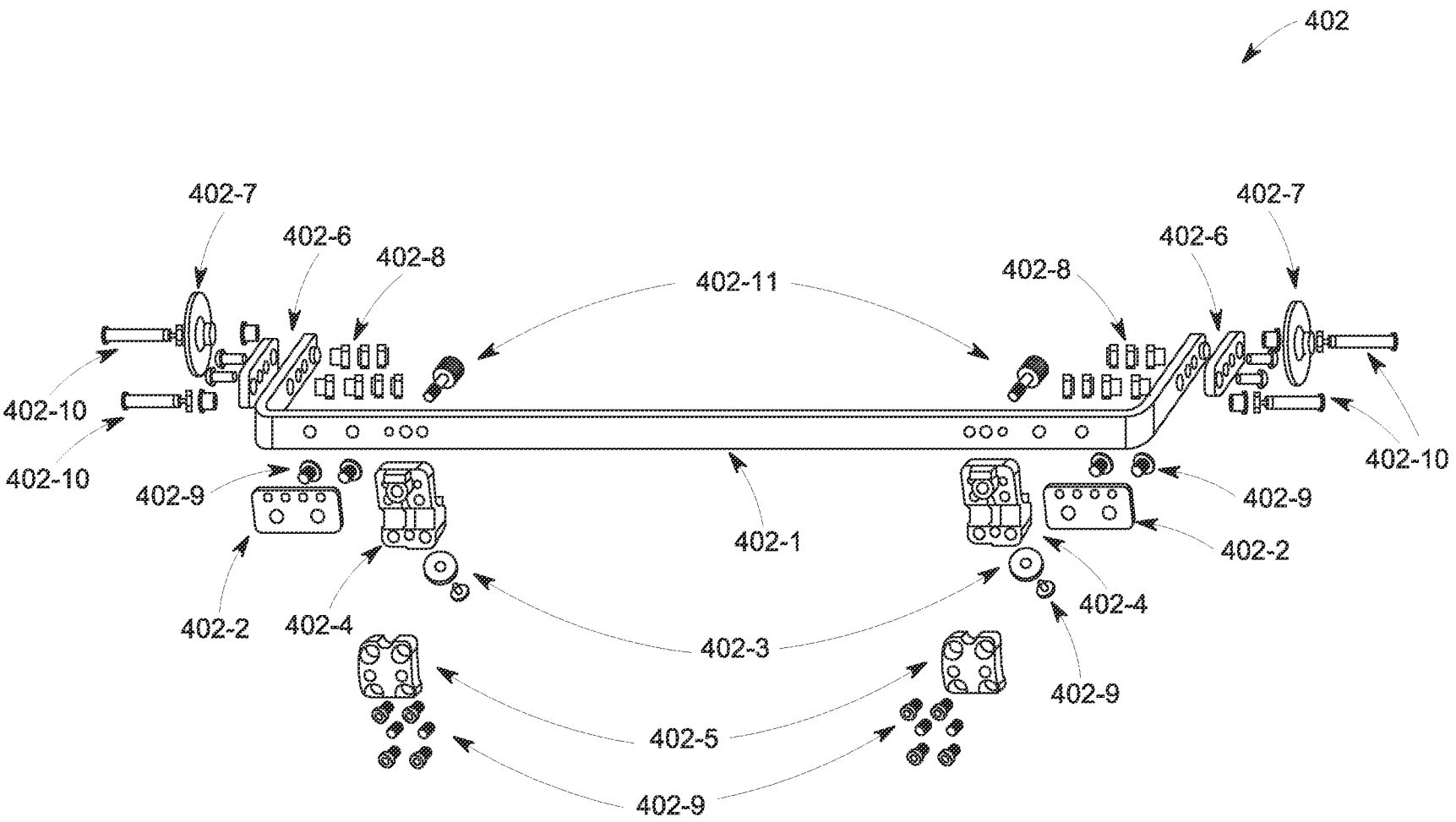
FIG. 16 illustrates a detailed exploded perspective view of the fixed frame assembly of FIG. 7A.

Referring to FIGS. 13, 15 and 16, details of the floating head assembly 400 are shown. The floating head assembly 400 can include a fixed frame assembly 402 (FIG. 16) that attaches to the linear head assembly attachment portion 303, described above. The fixed frame assembly 402, as shown in FIG. 16, can include a generally U-shaped fixed frame 402-1 where the wheels 402-7 can be mounted at the two ends of the U-shape. A wheel support 402-6 may be disposed along the end of the arms of the U-shaped fixed frame 402-1 and clevis pins 402-10 may be inserted into both the wheel 402-7 and the wheel support 402-6, with nylon inserts 402-8, for example, to secure the wheel 402-7 at the ends of the arms of the fixed frame 402-1. Of course, various means, as may be known in the art, may be used to rotatably support wheels at the ends of the fixed frame 402-1.

A magnet mount 402-4 may be attached in one or more locations, typically two or more locations, along the flat base of the U-shaped fixed frame 402-1. Floating head assembly mounting clamps 402-5 may be used to secure the fixed frame 402-1 to the linear head assembly attachment portion 303 of the strut 300. A spring plate 402-2 may be attached to the base of the U-shaped fixed frame 402-1. Typically, one spring plate 402-2 may be disposed adjacent each of the magnet mounts 402-4. Thus, if there are two magnet mounts 402-4, then two spring plates 402-2 may be used. Mounting hardware 402-9 may be used, as known in the art, to make the appropriate connections. A magnet 402-3 may be disposed in the bottom of the magnet mount 402-4, as shown.

The floating frame assembly 401 (FIG. 15) can include a floating frame 401-1 being generally rectangular in shape. A front edge of the floating frame 401-1 can have a finishing blade skimmer 401-2 (also referred to as skimmer 401-2 or squeegee 401-2) attached thereto and extending along the length of the floating frame 401-1.

On the length opposite the skimmer 401-2, spring plates 401-3 may be mounted, where the number of spring plates 401-3 may match the number of spring plates 402-2 of the fixed frame 402-1. Further, the spring plates 402-2, 401-3 may be disposed generally along the same positions of the rectangular shape of the floating frame 401-1 and the base of the U-shaped fixed frame 402-1. Springs 401-6 may interconnect the fixed frame 402-1 and the floating frame 401-1 at their respective spring plates 402-2, 401-3.

Adjacent the spring plates 401-3, a magnet mount 401-5 may be attached along the floating frame 401-1. A magnet 401-4 may be disposed in the magnet mount 401-5 and secured by appropriate hardware 401-7. The magnet 401-4 may align with the magnet 402-3 of the fixed frame assembly 402 when the floating frame 401 is pivotably mounted on the fixed frame assembly 402.

Figure 17:
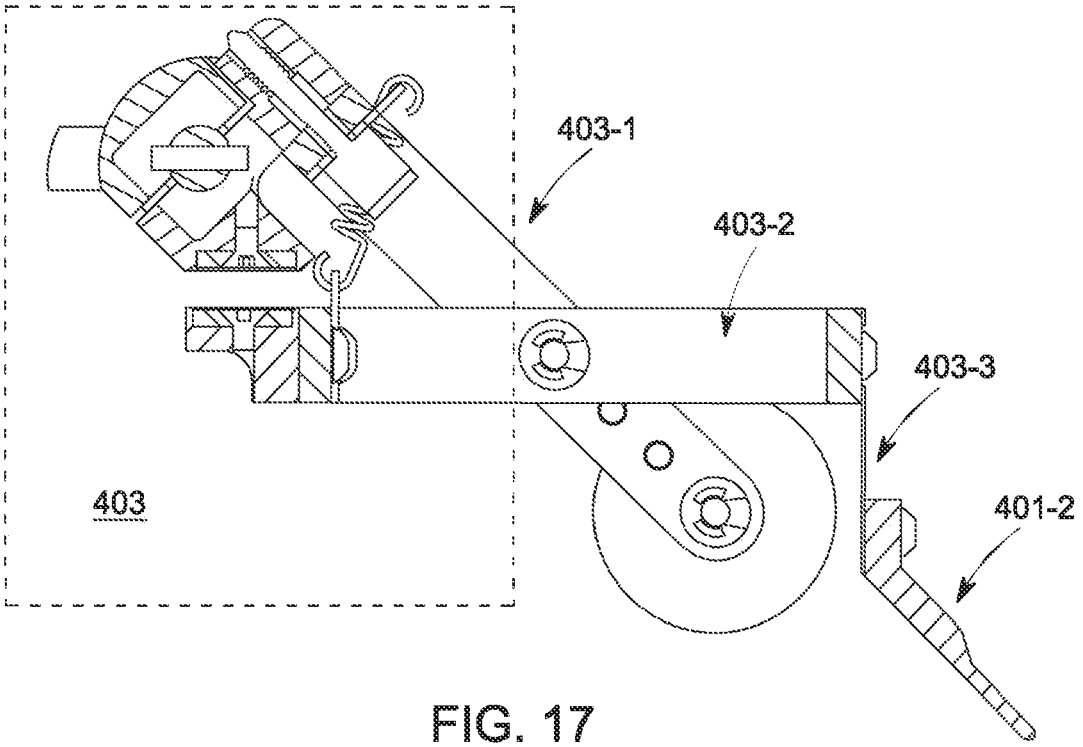
FIG. 17 illustrates a detailed side view of a damper assembly of the floating head assembly of FIG. 7A.
Figure 18:
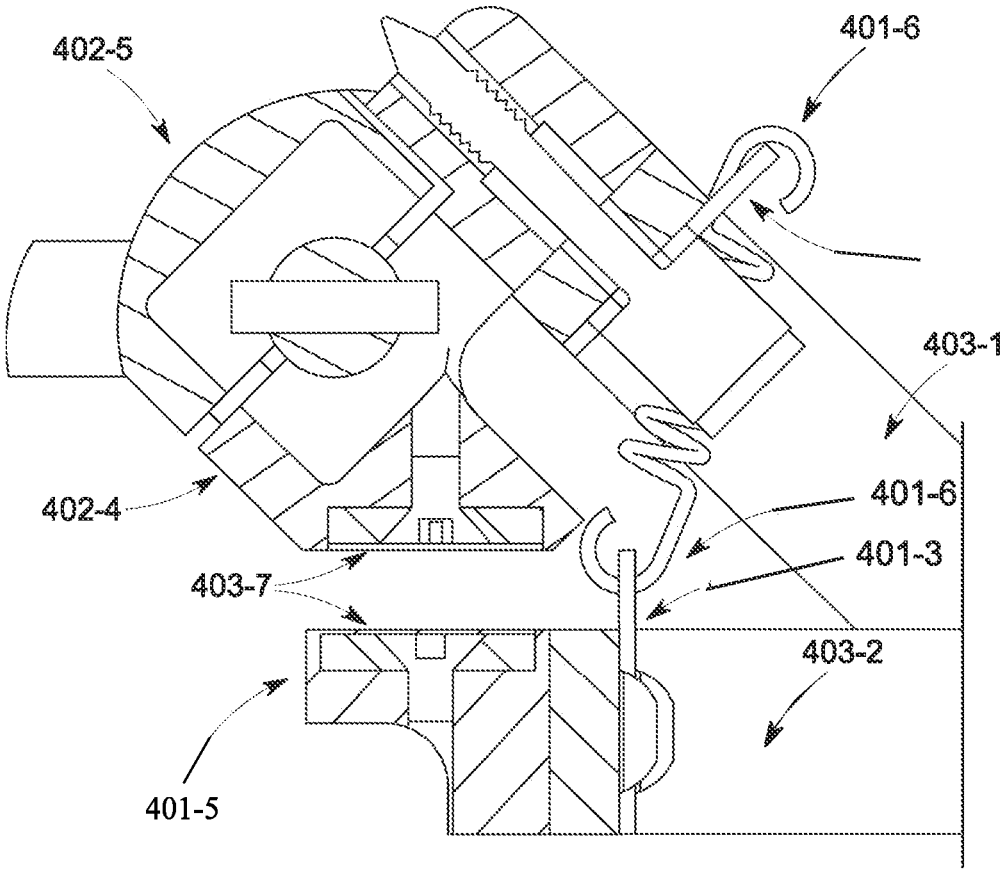
FIG. 18 illustrates a further detailed side view of the damper assembly of FIG. 17.

FIGS. 17 and 18 show detail of the interaction between the fixed frame assembly 402 (FIG. 7A) and the floating frame assembly 401 (FIG. 7A) when the arms 403-1 of the fixed frame 402-1 are attached to the sides 403-2 of the floating frame 401-1. A damper assembly 403 is created by the opposing force 403-7 between the magnets, where the magnet mount 402-4 of the fixed frame 402-1 aligns with the magnetic mount 401-5 of the floating frame 401-1 to create the opposing force 403-7 between the magnets. The spring 401-6 urges the frames 401, 402 together, while the damper assembly 403 pushes them apart, thus providing a dampening of the movement of the finishing blade skimmer 401-2 during use of the tool. FIG. 17 further illustrates how the skimmer 401-2 may be attached to the floating frame 401-1 via a mounting plate 403-3. The finishing blade skimmer may be mounted with or without a mounting plate. It should be understood that the size of the skimmer, as discussed above, may be changed depending on the application and may be, for example, at lengths between about 6 inches through 36+ inches.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A drywall finishing tool comprising:
- a main body assembly;
- a strut having a proximal end extending from a distal end of the main body assembly;
- a floating head assembly disposed on a proximal end of the strut;
- a fixed frame attached to a linear portion at an end of the strut; and
- a floating frame pivotably attached to the fixed frame;
- a blade attached at a distal end of the floating frame; and
- wheels attached at a distal end of the fixed frame.

2. The drywall finishing tool of claim 1, wherein the floating frame resiliently pivots relative to the fixed frame against one or more springs, wherein the one or more springs allows the blade to float along a surface to remove excess material deposited by the drywall finishing tool.

3. The drywall finishing tool of claim 1, further comprising an adjustable sliding saddle that travels fore and aft on the main body assembly.

4. The drywall finishing tool of claim 3, further comprising an extension pole attached to the sliding saddle.

5. The drywall finishing tool of claim 4, further comprising:
- a spray gun attached to one end of the extension pole; and
- a spray tip attached to a spray head, attached to the distal end of the extension pole, wherein
- the wheels guide a spray fan of material released from the spray tip attached to a spray head, attached to the spray gun via the extension pole.

6. The drywall finishing tool of claim 1, wherein the main body assembly has a longitudinal axis formed from two tubular members disposed side-by-side, wherein each of the two tubular members attach to two ends of the strut.

7. The drywall finishing tool of claim 1, further comprising a spray supply input hose interconnecting a spray gun with material to be applied by the drywall finishing tool.

8. The drywall finishing tool of claim 7, wherein the spray supply input hose is up to 50 feet in length.

9. The drywall finishing tool of claim 1, wherein the blade has a width from about 6" to about 36".

10. The drywall finishing tool of claim 1, wherein the blade is replaceable.

11. The drywall finishing tool of claim 2, further comprising one or more fixed frame magnets attached to the fixed frame and one or more floating frame magnets attached to the floating frame, wherein the fixed frame magnets utilize opposing force to repel the floating frame magnets to provide a dampening of movement between the fixed frame and the floating frame.

12. A drywall finishing tool comprising:
- a main body assembly;
- a strut having a proximal end extending from a distal end of the main body assembly;
- a floating head assembly disposed on a proximal end of the strut;

a fixed frame attached to a linear portion at an end of the strut;

a floating frame pivotably attached to the fixed frame;

a finishing blade attached at a distal end of the floating frame;

wheels attached at a distal end of the fixed frame; and one or more fixed frame magnets attached to the fixed frame and one or more floating frame magnets attached to the floating frame, wherein the fixed frame magnets utilize opposing force to repel the floating frame magnets to provide a dampening of movement between the fixed frame and the floating frame.

13. The drywall finishing tool of claim 12, wherein the floating frame resiliently pivots relative to the fixed frame against one or more springs, wherein the one or more springs allows the finishing blade to float along a surface to remove excess material deposited by the drywall finishing tool.

14. The drywall finishing tool of claim 13, wherein the fixed frame magnets repel the floating frame magnets in a direction against a force provided by resilient extension of the spring.

15. The drywall finishing tool of claim 14, further comprising an adjustable sliding saddle that travels fore and aft on the main body assembly.

16. The drywall finishing tool of claim 15, further comprising an airless extension pole attached to the sliding saddle.

17. The drywall finishing tool of claim 16, further comprising:

a spray gun attached to one end of the airless extension pole; and a spray tip attached to a spray head attached to the distal end of the airless extension pole, which is attached to the spray gun, wherein the wheels guide a spray fan of material released from the spray tip controlled by the spray gun.

18. The drywall finishing tool of claim 12, wherein the main body assembly has a longitudinal axis formed from two tubular members disposed side-by-side, wherein each of the two tubular members attach to two ends of the strut.

19. A drywall finishing tool comprising:

a main body assembly;

a strut having a proximal end extending from a distal end of the main body assembly;

a floating head assembly disposed on a proximal end of the strut;

a fixed frame attached to a linear portion at an end of the strut;

a floating portion, pivotably attached to the fixed frame;

a finishing blade attached at a distal end of the floating frame;

wheels attached at a distal end of the fixed frame; and one or more fixed frame magnets attached to the fixed frame and one or more floating frame magnets attached to the floating frame, wherein the fixed frame magnets repel the floating frame magnets to provide a dampening of movement between the fixed frame and the floating frame, wherein the main body assembly has a longitudinal axis formed from two tubular members disposed side-by-side, wherein each of the two tubular members attach to two ends of the strut;

the floating frame resiliently pivots relative to the fixed frame against one or more springs, wherein the one or more springs allows the finishing blade to simultaneously float along a surface to remove excess material deposited by the drywall finishing tool; and the fixed frame magnets repel the floating frame magnets in a direction against an opposing force provided by resilient extension of the spring.

* * * * *